US011019969B2

(12) United States Patent
Geurden et al.

(10) Patent No.: US 11,019,969 B2
(45) Date of Patent: Jun. 1, 2021

(54) CONVERTIBLE VACUUM-CLEANER NOZZLE

(71) Applicant: WESSEL-WERK GmbH, Reichshof-Wilbergerhuette (DE)

(72) Inventors: Wolfgang Geurden, Much-Marienfeld (DE); Andreas Cramer, Gummersbach (DE)

(73) Assignee: WESSEL-WERK GMBH, Reichshof-Wilbergerhuette (DE)

( * ) Notice: Subject to any disclaimer, the term of this patent is extended or adjusted under 35 U.S.C. 154(b) by 304 days.

(21) Appl. No.: 16/199,404

(22) Filed: Nov. 26, 2018

(65) Prior Publication Data

US 2019/0159641 A1 May 30, 2019

(30) Foreign Application Priority Data

Nov. 30, 2017 (EP) ..... 17204720

(51) Int. Cl.
*A47L 9/06* (2006.01)
*A47L 9/02* (2006.01)
*A47L 5/36* (2006.01)

(52) U.S. Cl.
CPC ..... *A47L 9/0673* (2013.01); *A47L 5/36* (2013.01); *A47L 9/02* (2013.01); *A47L 9/066* (2013.01)

(58) Field of Classification Search
CPC . A47L 9/0673; A47L 5/36; A47L 9/02; A47L 9/066
See application file for complete search history.

(56) References Cited

U.S. PATENT DOCUMENTS 1,770,668 A * 7/1930 Martinet ..... A47L 9/0673 15/400
2,658,228 A * 11/1953 Meyerhoefer ..... A47L 9/0666 15/371
7,131,164 B2 11/2006 Uratani
2005/0022336 A1* 2/2005 Overvaag ..... A47L 9/0673 15/400

FOREIGN PATENT DOCUMENTS

DE 1058712 * 6/1959

* cited by examiner

*Primary Examiner* — David Redding
(74) *Attorney, Agent, or Firm* — Andrew Wilford

(57) ABSTRACT

A vacuum-cleaner nozzle assembly has a base nozzle forming a downwardly open suction mouth having a lower edge and of a predetermined horizontal width measured in a direction transverse to a working direction of the base nozzle. A first and second expansion fitting each form a respective downwardly open suction mouth of a predetermined horizontal width substantially greater than the width of the mouth of the base nozzle, the width of the second fitting being greater than that of the first fitting. Each expansion fitting has an upwardly open seat complementary to and fittable with the lower edge of the base nozzle and a suction port in the seat such that, when the base nozzlenestle is fitted to the seat, aspiration through the base nozzle draws air upward from the suction mouth of the respective expansion fitting.

14 Claims, 6 Drawing Sheets

CONVERTIBLE VACUUM-CLEANER NOZZLE

FIELD OF THE INVENTION

The present invention relates to vacuum-cleaner nozzle. More particularly this invention concerns a nozzle assembly that is convertible.

BACKGROUND OF THE INVENTION

A vacuum-cleaner nozzle assembly is known having a base nozzle of a first configuration and an expansion fitting for forming a second configuration. The assembly includes an adapter for connecting the expansion fitting to the vacuum-cleaner nozzle.

Vacuum-cleaner nozzles shape and guide with suction an air stream from a surface to be cleaned. The air stream is produced by a vacuum cleaner by a fan and enters into a suction air guide element through the vacuum-cleaner nozzle. The air stream pulls up dirt particles from the surface to be cleaned and carries them along until they are separated from the air stream in a dust collector. Depending on the field of application, different nozzle shapes have been created, for instance vacuum-cleaner nozzles for bare floors and/or carpeted floors, upholstery nozzles, groove nozzles, etc., that have to be brought along and fitted to the vacuum hose for different cleaning situations.

To reduce the complexity of this process, it is known to design vacuum-cleaner nozzles to be adaptable to a plurality of usage situations, for instance such that the distance between the vacuum-cleaner nozzle and the floor may be varied between a close bare-floor setting and a spaced carpet setting using adjustable spacing elements. The changes in the geometry that may be achieved in this manner, in particular for the base plate and the suction mouth, are however very limited. Therefore, modular vacuum-cleaner nozzle systems have also been suggested in which a small vacuum-cleaner nozzle may be inserted in an expansion body to form a larger nozzle. For example, a modular vacuum-cleaner nozzle having a floor nozzle and a mini-nozzle that may be placed therein is known from U.S. Pat. No. 7,131,164.

To expand the field of application of a modular nozzle, US '164 suggests a plurality of expansion stages of a modular nozzle that may be connected to a base nozzle in parallel adjacent to one another and/or series one after the other. The different connecting points involve a complex design and are highly susceptible to malfunction. The cleaning configurations that may be achieved in this manner are only useful in certain conditions. In addition the base nozzle itself is not a usable cleaning appliance, but serves merely for connection to the expansion fittings.

OBJECTS OF THE INVENTION

It is therefore an object of the present invention to provide an improved convertible vacuum-cleaner nozzle assembly.

Another object is the provision of such an improved convertible vacuum-cleaner nozzle assembly that overcomes the above-given disadvantages, in particular that provides a large number of different suction configurations that are not highly complex and that involve low material usage.

According to another object, the elements of this assembly should be very robust and should also be suitable for professional use.

SUMMARY OF THE INVENTION

A vacuum-cleaner nozzle assembly has according to the invention a base nozzle forming a downwardly open suction mouth having a lower edge and of a predetermined horizontal width measured in a direction transverse to a working direction of the base nozzle. A first and second expansion fitting each form a respective downwardly open suction mouth of a predetermined horizontal width substantially greater than the width of the mouth of the base nozzle, the width of the second fitting being greater than that of the first fitting. Each expansion fitting has an upwardly open seat complementary to and fittable with the lower edge of the base nozzle and a suction port in the seat such that, when the base nozzle is fitted to the seat, aspiration through the base nozzle draws air upward from the suction mouth of the respective expansion fitting.

In other words, the invention is a vacuum-cleaner nozzle assembly can form a first suction configuration having a nozzle body with a suction mouth arranged on the lower side thereof and connected to a suction port. The suction mouth of the nozzle body is of a first working width. A first expansion fitting for forming a second suction configuration has a first expansion body with a suction mouth arranged on the lower side thereof and connected to a suction port. The suction mouth of the first expansion fitting is of a second working width that is wider than the first working width, and the first fitting has an seat for connecting to the base nozzle so that the suction port of the first expansion body may be connected to the suction mouth of the base nozzle. According to the invention, a second expansion fitting for forming a third suction configuration has a second expansion body that has different dimensions than the first expansion body and a suction mouth arranged on the lower side thereof and connected to a respective suction port. A seat on the second fitting serves for connecting to the base nozzle, so that the suction port of the second expansion body may be connected to the suction mouth of the base nozzle.

A total of at least three different suction configurations may be implemented in the context of the inventive vacuum-cleaner nozzle assembly. On the one hand, the base nozzle may be used directly for vacuum cleaning, wherein an air stream may be drawn from a surface to be cleaned and passed through the suction mouth of the base nozzle into its suction port and aspirated via the connector tube to a suction air guide element. The base nozzle may be connected to the seat of a first expansion fitting prior to different cleaning situations, especially when a greater working width is required. In this case, the suction air guide element is designed such that the suction mouth of the base nozzle is connected to the suction port of the first expansion fitting. At least the great majority of the air stream entering the suction mouth of the base nozzle therefore first passes through the suction mouth of the first expansion fitting and the suction port thereof. The cleaning properties of this overall assembly formed in the context of the second suction configuration are primarily determined by the first expansion fitting and the design of its suction mouth.

In the context of the invention there is, as an alternative to the first expansion fitting, a second expansion fitting connectable to the base nozzle. In this case, the suction air guide element is also connected to the second expansion fitting such that the great majority of the air stream enters through the suction mouth of the second expansion fitting into the suction port arranged thereafter and from there is further conducted into the suction mouth of the base nozzle. The second expansion fitting has a different shape than the first expansion fitting, so that in the context of the third suction configuration it is preferably possible to handle other cleaning situations. In particular the suction mouth of the second expansion fitting is of a third working width that is wider than the second working width. Thus paths even wider than for the second suction configuration may be vacuumed on a surface to be cleaned, which can be very helpful in particular depending on the particle size distribution of the dirt to be removed and on the surface area of the surface to be cleaned.

Alternatively or in addition, however, the shape of the third suction configuration may differ from the second suction configuration in other aspects. For example, a larger base surface of the second expansion fitting may be provided, a greater depth in the working direction, or for example even a modified base plate configuration that has been optimized for use on specific floor coverings, for example wall-to-wall carpeting, in particular high-pile carpeting.

The invention affords significant savings in materials compared to vacuum-cleaner nozzle systems in which a plurality of complete specialized vacuum-cleaner nozzles that can be exchanged for one another are provided. In particular in the region of the connector tube and its articulated connection to the vacuum-cleaner body, duplicate embodiment of different vacuum-cleaner nozzles is avoided. Due to the reduction in materials, the nozzle assembly is easier to transport because it does not require as much space, which is especially advantageous when used in a professional capacity. In the context of the invention, increased effectiveness and stability of the specific suction configurations may be increased compared to the design of a vacuum-cleaner nozzle having a plurality of different nozzles that may be used in parallel and serially, each connected directly to the suction hose. It is advantageous here that there is always only a single connecting point to the connection between the seat of the expansion bodies and the base nozzle. Correspondingly, potential faulty air flows occur only at a single transition point and may also be sealed off with less design and material complexity.

The seat of the first expansion fitting and/or the seat of the second expansion fitting preferably has a sealing element. When connected, this provides a seal eliminating faulty air flows. With a flexible seal element or ring it is possible to conduct nearly the entire air stream through the suction mouth and the suction port of the corresponding expansion fitting.

It is particularly preferred that the invention may be used in vacuum-cleaner nozzle assemblies in which the base nozzle has a greater dimension in the transverse direction than in the working direction. In this case, a particularly stable connection to a base nozzle and the expansion bodies is possible. The suction air guide element may also be embodied better, since the suction mouth of the base nozzle thus already has a large transverse dimension. Consequently, it is particularly simple to connect the suction mouth of the base nozzle to the suction air guide element of an expansion fitting that is wider in the transverse direction.

Usefully, the seat of the first expansion fitting and the seat of the second expansion fitting are identical. In this way, particularly simple exchangeability of the two expansion fittings is provided, and in both cases the connection to the base nozzle is optimal and may function equally well.

In one particularly preferred embodiment, when connected, the seat of the first expansion fitting and/or the seat of the second expansion fitting encloses the lower edge of the mouth of the base nozzle in a horizontal plane (that is, in the transverse direction and in the working direction) in a positive fit. It is particularly preferred that the positive fit is produced in that the seat of the first expansion fitting and/or the seat of the second expansion fitting is positioned circumferentially against the base nozzle in the horizontal plane. This results in optimum force transmission, both in the transverse direction and in the working direction. The insertion of the base nozzle made of the seats occurs in the vertical direction. When received in a positive fit, positive sealing is also provided so that an additional sealing element for preventing faulty air flows may be omitted.

It is particularly useful that the base nozzle may be vertically locked in place in the seat of the first expansion fitting and/or in the seat of the second expansion fitting using a snap-fit connection. In a snap-fit connection, at least one snap-fit body is deformed and/or displaced by the insertion of the base nozzle into the seat, wherein the snap-fit body, when it reaches the final seated position for the base nozzle in the seat, at least in part recovers its shape and/or position, so that the base nozzle is held in the seat is a positive fit and/or in a force-fit.

For example, the snap-fit connection may be formed by an elastically deformable holding strip that, when the base nozzle is inserted, is pushed to the side in the seat and once the final seated position has been achieved recovers its shape, at least in part, in the seat. For removing the base nozzle from the seat, a greater amount of force must be used to again deform the holding strip. A separate releasing device is not necessary.

Likewise, the snap-fit connection may be provided by a non-deformable snap-fit body that is displaceably held in the seat. Due to an elastic application of force, the snap-fit body is pressed into the seat such that the base nozzle is slightly too large for the seat, which is reduced in size by the snap-fit body. When the base nozzle is inserted, the snap-fit body is pushed back against the application of force through the base nozzle so that the snap-fit body exposes the path into the seat. Once the base nozzle has reached the final seated position in the seat in which the second or third suction configuration is formed, the snap-fit body is moved back, at least in part, to its original position, so that application of force at least partially inhibits removal of the base nozzle from the seat, but preferably holds due to shape. In the latter case, the snap-fit element must be unblocked by being pulled out of the blocking position in order to be able to remove the base nozzle from the seat.

In one preferred embodiment, the base nozzle is transversely delimited by a first narrow side and an opposite second narrow side. For locking in place vertically within the seat, the first narrow side of the base nozzle engages from behind under an overhang of the seat of the first expansion fitting or the second expansion fitting. At the same time, the base nozzle may be locked in place on the second narrow side by a snap-fit element adjacent the seat. The vertical locking in place is also detached on at least one side using a positive fit, which involves less design complexity and good robustness.

The snap-fit element may preferably be unlocked using a latch element, in particular foot operable. The latter may be actuated with the foot during use with very little effort by the user in order to be able to remove the base nozzle from the seat of the specific expansion fitting. The snap-fit element and the latch element may preferably be embodied in a single piece.

Preferably at least one pile brush is arranged in the base nozzle. Thus the latter may be used in the first suction configuration in particular as an upholstery nozzle.

Usefully, however, sealing, carrying, and/or cleaning elements are also arranged on the first expansion fitting and/or on the second expansion fitting. These may be in particular brush strips, sealing lips, pile brushes, and/or rubber strips and/or lips covered with pile brush fabric. The effectiveness of the second and/or third suction configuration for specific types and/or sizes of dirt particles may be intentionally adjusted with the appropriate selection.

In one preferred embodiment, at least one support roller is provided on the first expansion fitting and/or on the second expansion fitting. Rollers also support a vacuum-cleaner nozzle on smooth hard floors, wherein the distance from the floor may be set precisely. At the same time, at least in limited circumstances, support rollers may also be used for providing an automatic adjustment to different floor coverings. This is because at least narrow support rollers having a width of a few millimeters sink into soft carpeting and have no bearing capacity there.

It is particularly preferred that the connector tube is movably arranged on the body by an articulated assembly. The connector tube is pivotable about at least one axis in order to permit control of the base nozzle and/or to permit adjustment to the floor. In one particularly preferred embodiment, the nozzle assembly furthermore comprises an alternative base nozzle that may be alternatively likewise connected to the seat of the first expansion fitting and/or the seat of the second expansion fitting. The alternative base nozzle may have additional suction openings that are not coupled to the seat and/or may have support elements. For example, it is possible to embody the alternative base nozzle such that, in the context of suction configurations, in conjunction with the first expansion fitting or the second expansion fitting a double jointed assembly is formed in which the expansion fitting is movably connected, relative to the connector tube, about two parallel pivot axes that are spaced apart from one another and run in the transverse direction.

In one preferred embodiment, the alternative base nozzle has a body identical to the base nozzle and a different connector tube and/or a different articulated assembly for connecting the connector tube to the body. Using appropriately matched connector tubes and/or articulated assemblies, the inventive vacuum-cleaner nozzle assembly may be adapted in a particularly simple manner for applications with different controllability of the suction configurations. Likewise, the same expansion fittings may be used seamlessly with different formats for the suction air guide element, for example different tube diameters for a suction tube. The alternative vacuum nozzle, with its different embodiment of the connector tube, simultaneously functions as an adapter. This facilitates use in professional settings, where vacuum devices of different manufacturers and models are used side by side.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
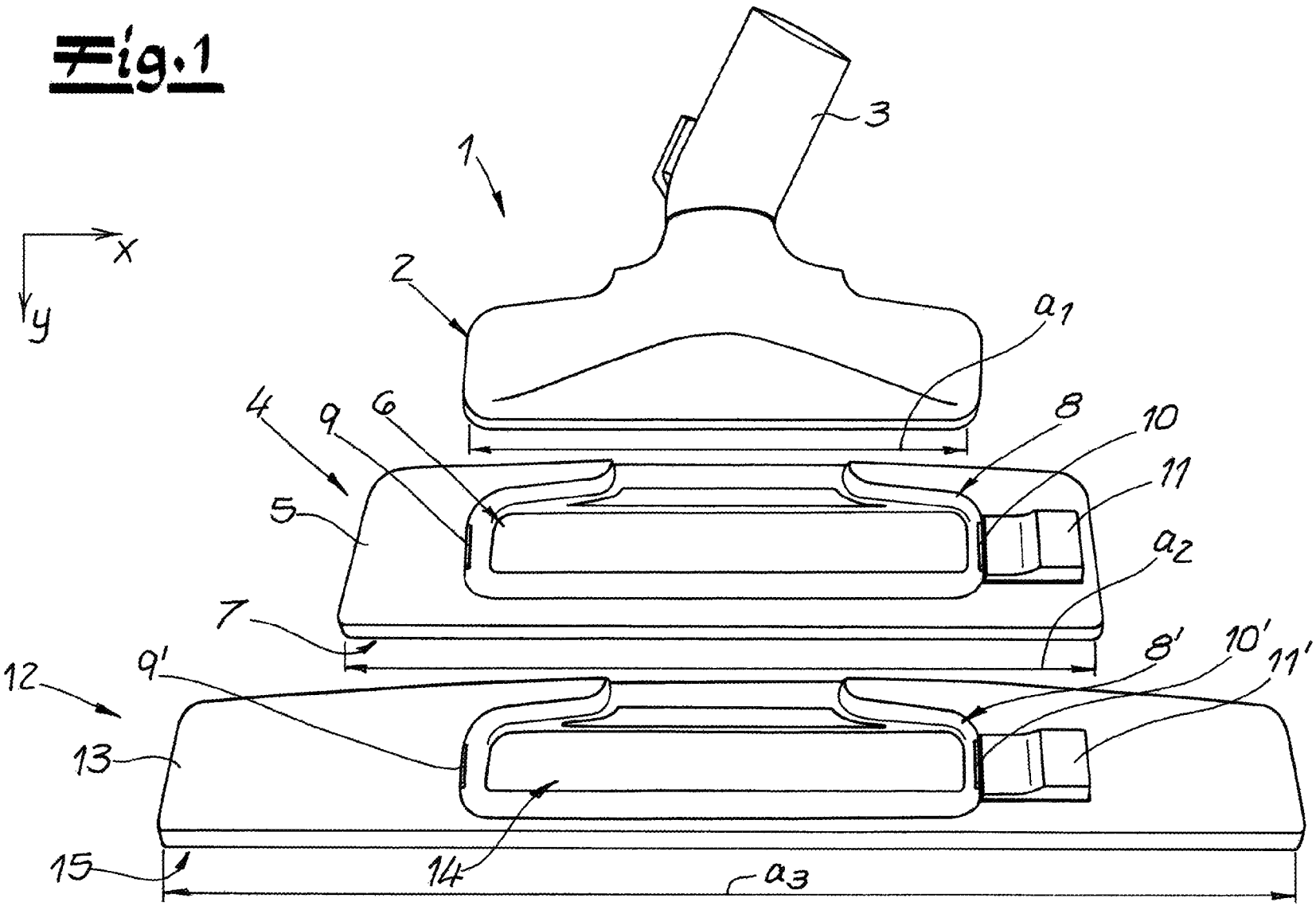
FIG. 1 is a top view of a base nozzle according to the invention.
Figure 4A:
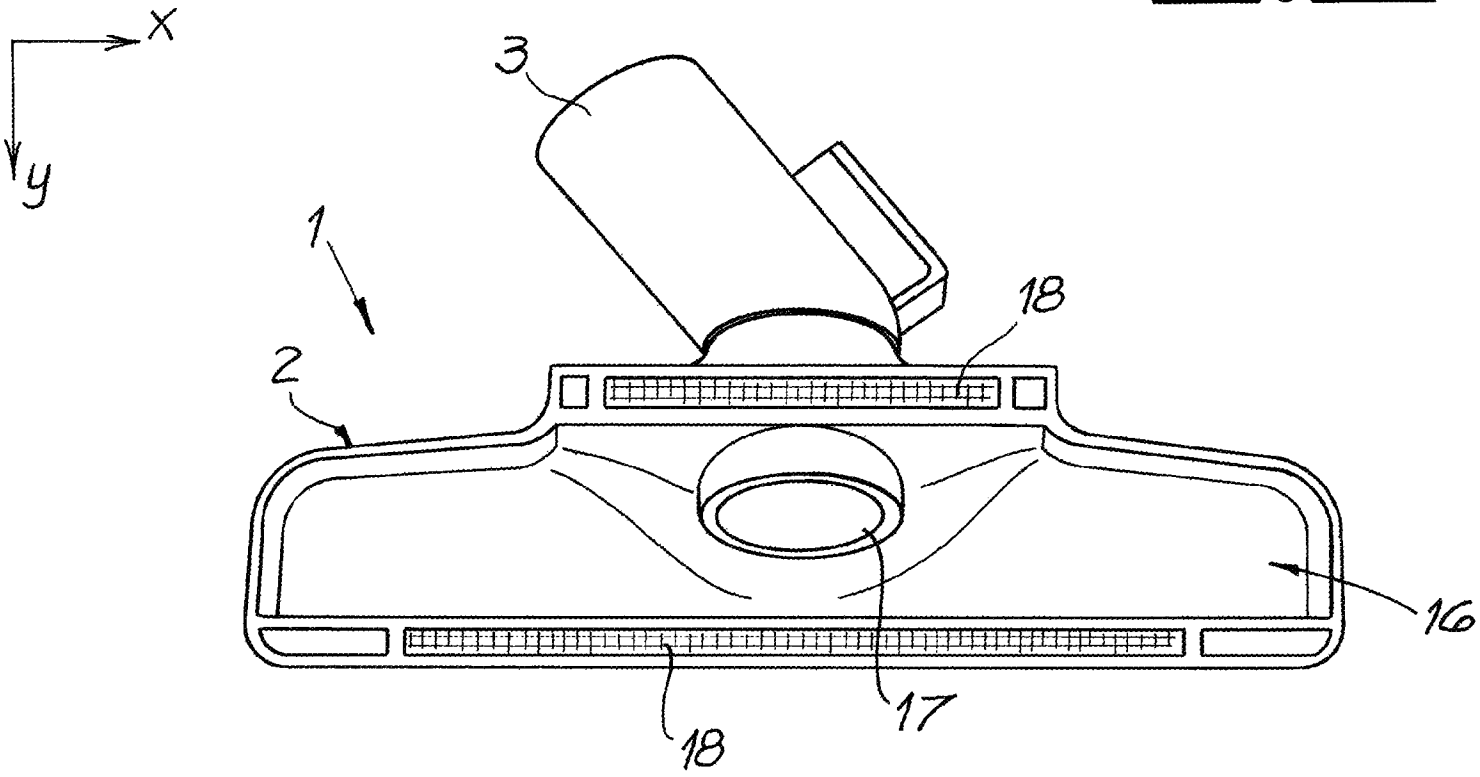
FIG. 4A is a bottom view of the base nozzle of FIG. 1.

As seen in FIGS. 1 and 4A, a vacuum-cleaner nozzle assembly comprises a base nozzle 1 having a nozzle body 2 and a suction mouth 16 (FIG. 4*a* only) into which opens a suction port 17 and that is of a first working width $a_1$ in a transverse direction x. A connector 3 connects to the body 2 rearward in the working direction y. The connector 3 is pivotal on the body 2 about a pivot axis extending parallel to the working direction y. The base nozzle 1 has a flat lower surface or edge at which opens a suction mouth 16 (FIG. 4A) into which in turn opens a suction port 17 from which an air stream is withdrawn through the connector 3. The front and rear edges of the nozzle 1 bounding the front and rear edges of the mouth 16 are provided with brushes or formations 18 adapted for contact with a flat surface. thus this nozzle 1 is usable by itself for cleaning a surface or floor where a small width is needed, for instance in cleaning an upholstered piece of furniture or a vehicle interior.

Figure 2:
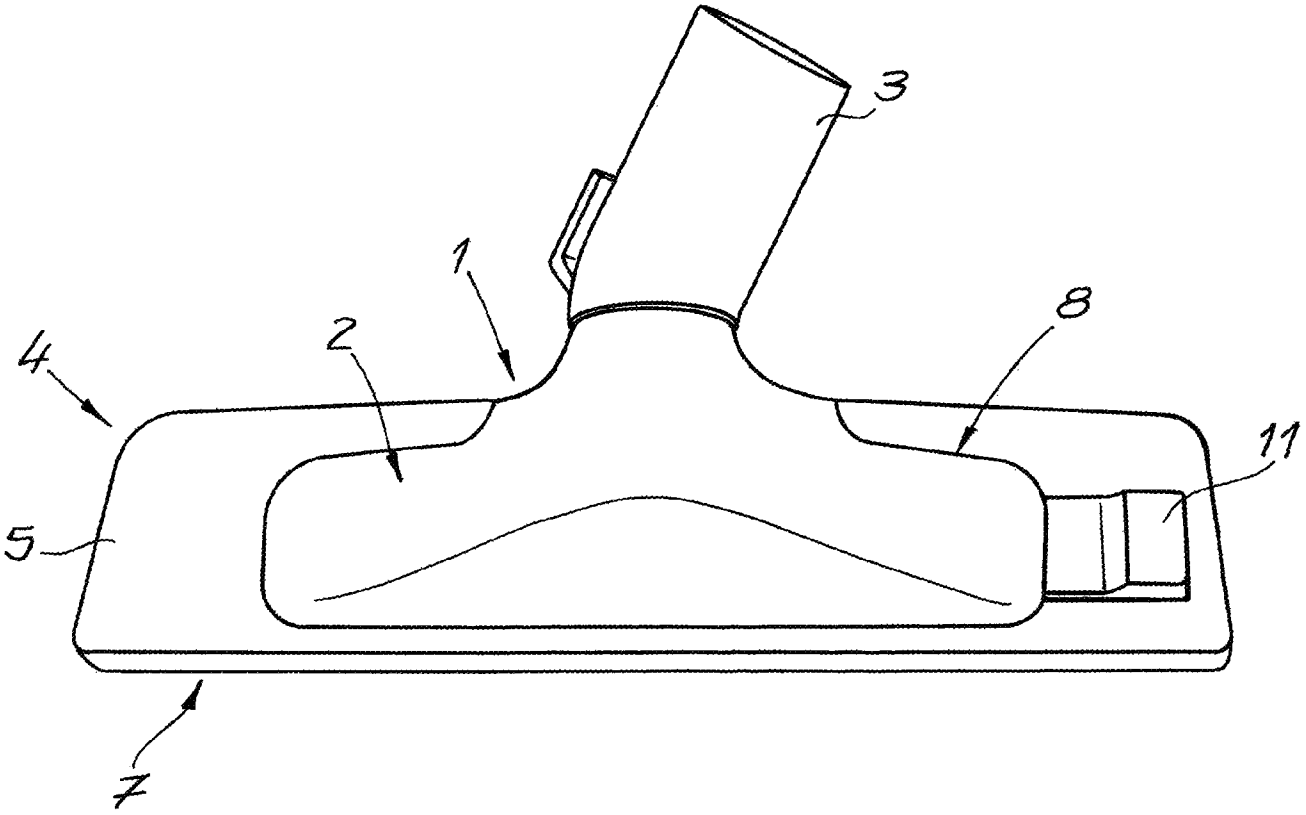
FIG. 2 is a top view of the nozzle assembly according to the invention in a second configuration.

There is also as shown in FIG. 2 a first expansion fitting 4 that has a first body 5 with a suction mouth 7 opening on the lower side thereof and into which opens a suction port 6 here formed to complementarily fit with the lower edge of the first nozzle body 2. The suction mouth 7 is of a working width $a_2$ measured in the transverse direction x that is wider than the first working width $a_1$ of the base nozzle 1. An seat 8 for connecting to the lower edge of the base nozzle 1 is provided on the top of the body 5 of the first expansion fitting 4 to ensure a tight fit between the suction port 6 and the nozzle body 2. The seat 8 is embodied such that the base nozzle 1 is held therein in a positive fit in the working direction y and in the transverse direction x. The base nozzle 1 is circumferentially enclosed by the seat 8 on three sides. When the base nozzle is inserted into the seat 8, the suction port 6 of the body 5 of the first expansion fitting 4 in effect opens into the suction mouth 16 of the base nozzle 1.

For attaching the top side of the first expansion fitting 4 to the base nozzle 1, the narrow end of the seat 8 has an overhang 9 under which a narrow end of the nozzle body 2 can engage from behind. The opposite second narrow end of the seat 8 has a snap-fit latch element 10 that may be used to lock in place the opposite narrow end of the base nozzle 1 fitted in the seat 8. When connected, the snap-fit element 10 holds the base nozzle 1 positively in the seat 8. The snap-fit element 10 may be released a tab 11 operable by the user's foot.

When clipped together as shown in FIG. 2 the base nozzle 1 and expansion fitting 4 for a robust assembly capable of cleaning a smooth floor or the like.

Figure 3:
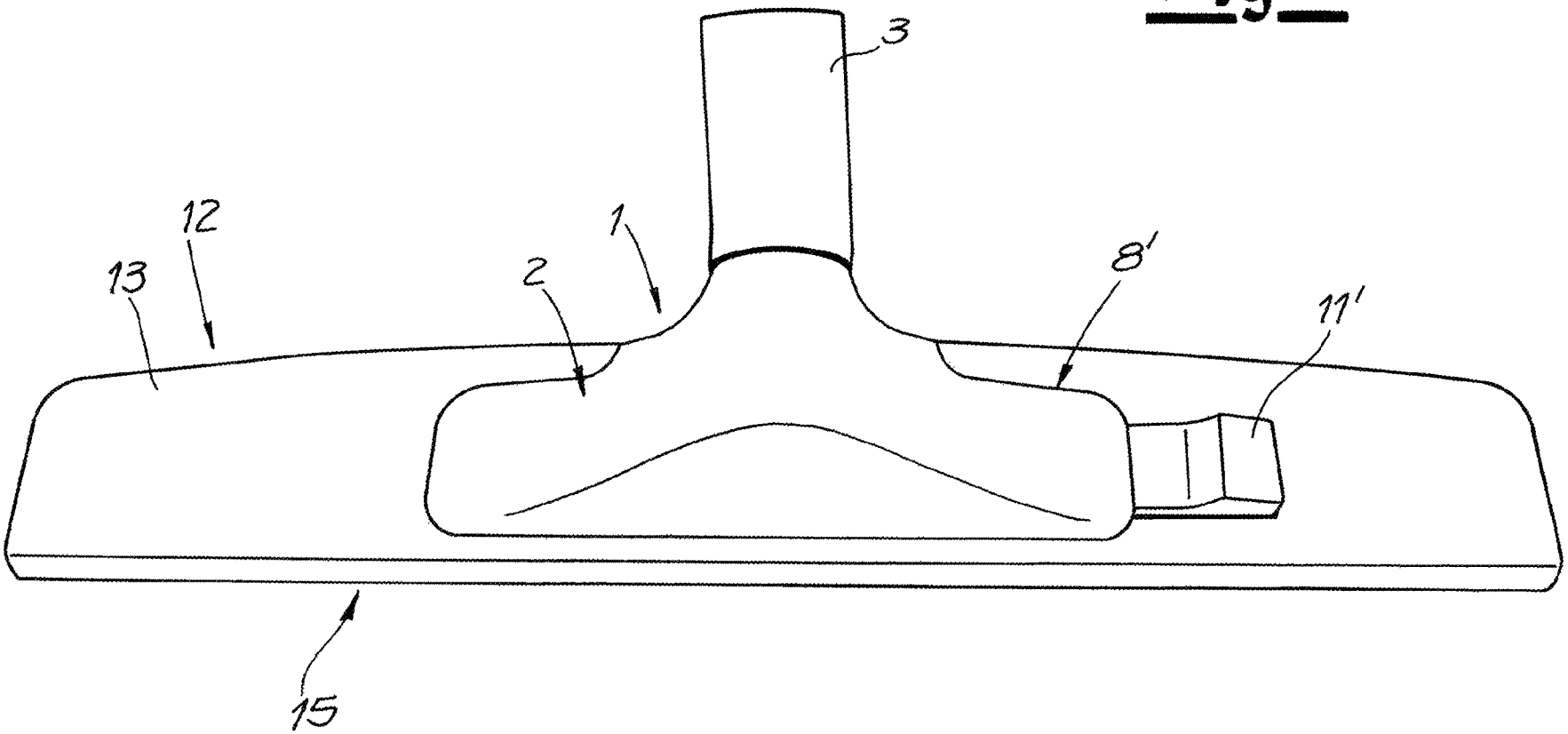
FIG. 3 is a top view of the nozzle assembly in accordance with the invention in a third configuration.
Figure 4B:
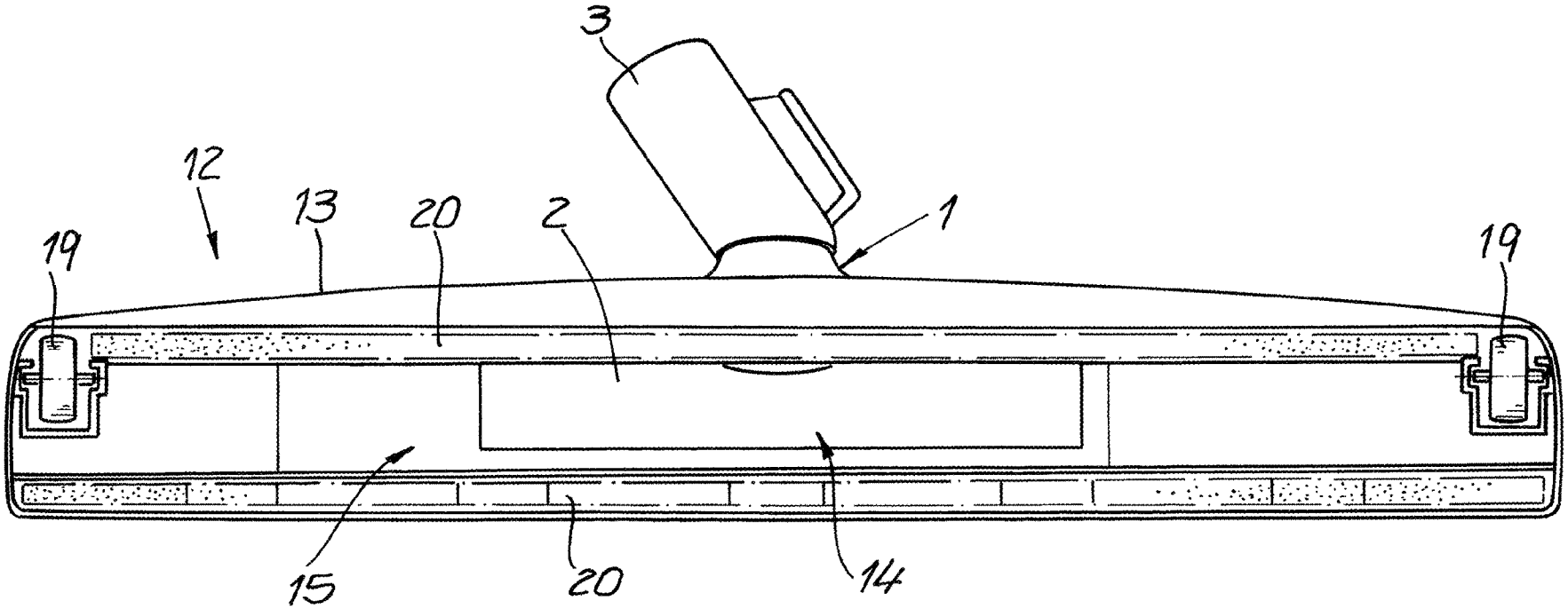
FIG. 4B is a bottom view of the third configuration of FIG. 3.

According to the invention as shown in FIGS. 3 and 4B, the vacuum-cleaner nozzle assembly furthermore has a second expansion fitting 12 with a body 13 having a suction mouth 15 opening downward on the lower side thereof and connected to a suction port 14. The dimensions of the body 13 of the second expansion fitting 12 differ from those of the body 5 of the first expansion fitting 4 only in that the suction mouth 15 is of a third working width $a_3$ that is larger than the second working width $a_2$. The vacuum-cleaner nozzle assembly 1, the first expansion fitting 4, and the second expansion fitting 12 all have a greater dimension in the transverse direction x than in the working direction y.

The top of the body 13 of the second expansion fitting 12 has an seat 8' that is identical to the seat 8 of the first expansion fitting 4. The base nozzle is also fixed horizontally using a positive fit. Vertical fixation occurs using an overhang 9' and a snap-fit element 10' that may be unlocked using a latch element 11'.

The wide configuration of FIG. 3 is suitable for cleaning a large for, to which end as shown in FIG. 4B th front and rear edges of the body 13 are provided with brush strips 20 and the ends of the fitting 13 have rollers facilitating travel on a planar surface to be cleaned such as a floor. The brush strip on the leading edge in the working direction has interruptions for the passage of larger particles.

Figure 5:
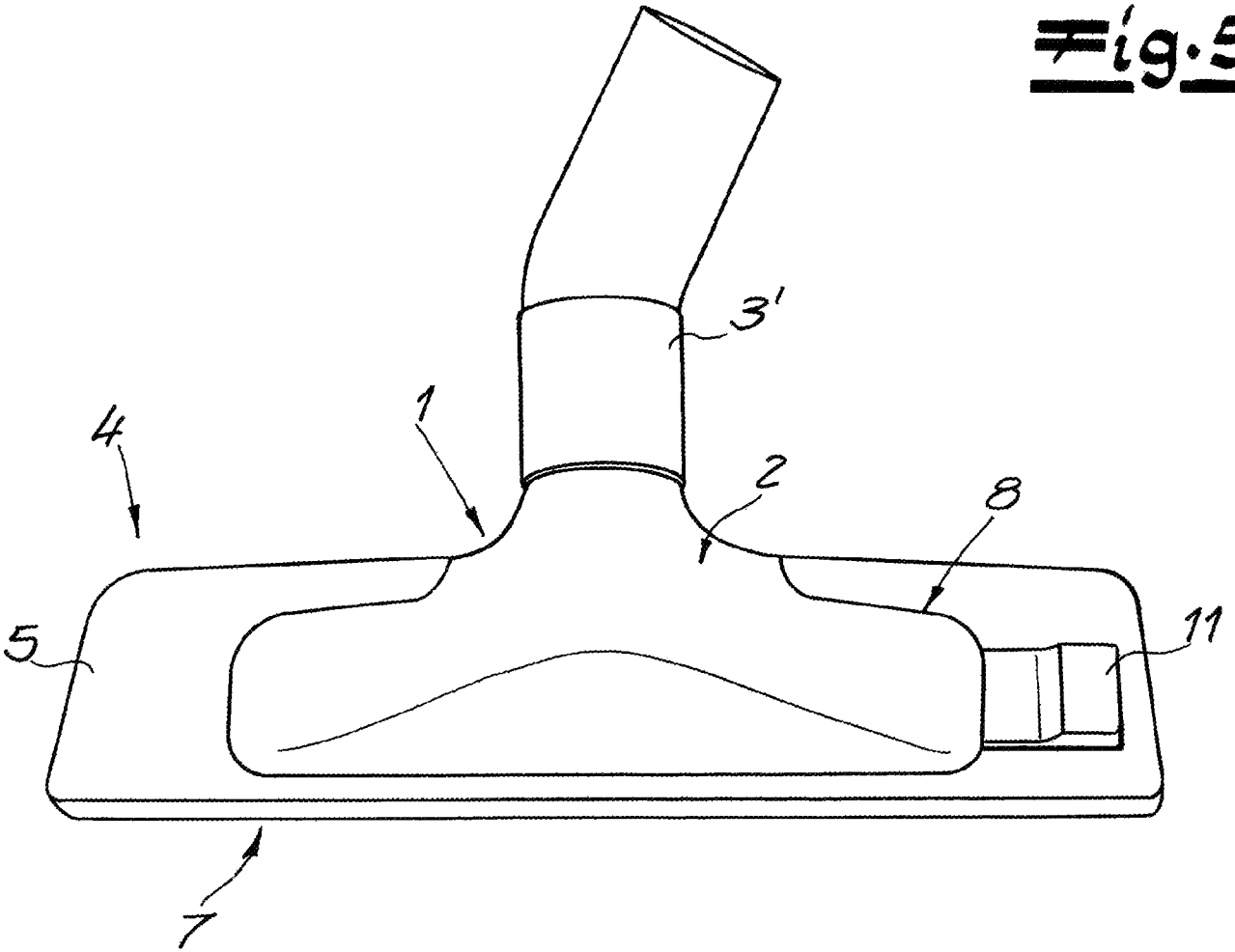
FIG. 5 is a variant of the second configuration of FIG. 2 with an alternative base nozzle.

FIG. 5 shows another embodiment. Here the body 2' is provided with a swivel connector 3' for connection to the vacuum hose or wand.

We claim:

1. A vacuum-cleaner nozzle assembly comprising:

a base nozzle forming a downwardly open suction mouth having a lower edge and of a predetermined horizontal width measured in a direction transverse to a working direction of the base nozzle, the nozzle having a suction connector for aspiration of air up through the mouth;

a first expansion fitting forming a downwardly open suction mouth of a predetermined horizontal width substantially greater than the width of the mouth of the base nozzle, the expansion fitting having an upwardly open seat complementary to and fittable with the lower edge of the base nozzle and a suction port in the seat such that, when the base nozzle is fitted to the seat, aspiration through the base nozzle draws air upward from the suction mouth of the first expansion fitting;

a second expansion fitting forming a downwardly open suction mouth of a predetermined horizontal width substantially greater than the width of the mouth of the first expansion fitting, the expansion fitting having an upwardly open seat fittable with the edge of the base nozzle and a suction port therein such that, when the base nozzle is fitted to the seat of the second expansion fitting, aspiration through the base nozzle draws air upward from the suction mouth of the first expansion fitting; and rollers on the second expansion fitting for supporting same on a floor.

2. The vacuum-cleaner nozzle assembly defined in claim 1, wherein the base nozzle is wider in the transverse direction than in the working direction.

3. The vacuum-cleaner nozzle assembly defined in claim 1, wherein the seat of the first expansion fitting and the seat of the second expansion fitting are identical.

4. The vacuum-cleaner nozzle assembly defined in claim 3, wherein, each of the seats fits around the edge of the base nozzle in the transverse direction and in the working direction.

5. The vacuum-cleaner nozzle assembly defined in claim 1, further comprising:

means on each of the fittings for vertically locking the base nozzle in the respective seat.

6. The vacuum-cleaner nozzle assembly defined in claim 5, wherein the means for vertically locking includes:

at one narrow end of the respective fitting an overhang under which a narrow end of the base nozzle is fittable; and a latch on an opposite narrow end of the respective fitting movable between a position holding an opposite narrow end of the base nozzle and a position freeing the opposite narrow end of the base nozzle.

7. The vacuum-cleaner nozzle assembly defined in claim 6, wherein the latch is operable by a foot of a user of the nozzle assembly.

8. The vacuum-cleaner nozzle assembly defined in claim 1, further comprising:

a transversely extending pile brush on the base nozzle at the edge of the mouth.

9. The vacuum-cleaner nozzle assembly defined in claim 8, further comprising:

another transversely extending pile brush on each of fittings along the edge of the mouth thereof.

10. The vacuum-cleaner nozzle assembly defined in claim 1, further comprising:

a seal ring extending peripherally around the seat of each of the fittings engageable with the edge of the base nozzle when fitted with the respective seat.

11. The vacuum-cleaner nozzle assembly defined in claim 1, wherein the connector is a short tube extending rearward and upward from the body.

12. The vacuum-cleaner nozzle assembly defined in claim 11, wherein the tube has a swivelable end.

13. The vacuum-cleaner nozzle assembly defined in claim 1, further comprising:

an alternative base nozzle connectable to the seat of the first and/or of the second expansion fitting.

14. The vacuum-cleaner nozzle assembly defined in claim 13, wherein the alternative base nozzle has a body identical to the base nozzle and a different connector.

* * * * *